US006074115A

United States Patent [19]

Fantinelli

[11] Patent Number: 6,074,115

[45] Date of Patent: Jun. 13, 2000

[54] PENCIL, PARTICULARLY A COLORED PENCIL AND A SET OF PENCILS

[75] Inventor: Ary Alonso Fantinelli, São Paulo, Brazil

[73] Assignee: A.W. Faber-Castell S.A., Brazil

[21] Appl. No.: 08/305,441

[22] Filed: Sep. 13, 1994

[30] Foreign Application Priority Data

Nov. 23, 1993 [BR] Brazil ..... 9304806

[51] Int. Cl.[7] ..... B43K 27/04

[52] U.S. Cl. ..... 401/35; 401/194

[58] Field of Search ..... 401/194, 35, 49, 401/82, 83, 84, 97; 40/334; D19/45, 48, 47, 147; 273/157 R

[56] References Cited

U.S. PATENT DOCUMENTS

| | | | |
|---|---|---|---|
| D. 141,631 | 6/1945 | Chapman | D19/45 X |
| D. 294,281 | 2/1988 | Song | D19/47 |
| 572,105 | 12/1896 | Cummings et al. | 401/83 X |
| 627,512 | 6/1899 | Lippincott | 401/84 |
| 788,998 | 5/1905 | Buckingham | 401/84 |
| 1,066,333 | 7/1913 | Snyder | 401/82 |

FOREIGN PATENT DOCUMENTS

| | | | |
|---|---|---|---|
| 11087 | 10/1992 | Austria | 401/84 |
| 381818 | 10/1989 | European Pat. Off. | 401/194 |
| 229700 | 9/1989 | Japan | 401/49 |
| 509664 | 7/1939 | United Kingdom | 401/35 |
| 00782 | 2/1985 | WIPO | 401/35 |

*Primary Examiner*—David J. Walczak

*Attorney, Agent, or Firm*—Smith, Gambrell & Russell, LLP; Beveridge, DeGrandi, Weilacher & Young Intellectual Property Group

[57] ABSTRACT

In a set of colored pencils, a cut-out is formed in the longitudinal surface of each pencil to expose the lead so that the color or hue of the pencil is immediately identifiable. The pencils are useful as a puzzle type game because they have flat surfaces with markings which, when the pencils are arranged in a determined sequence, collectively form an integral configurative pattern. The integral configurative pattern is formed of a plurality of pattern portions which are the markings on the individual pencils.

17 Claims, 1 Drawing Sheet

PENCIL, PARTICULARLY A COLORED PENCIL AND A SET OF PENCILS

Figure 1:
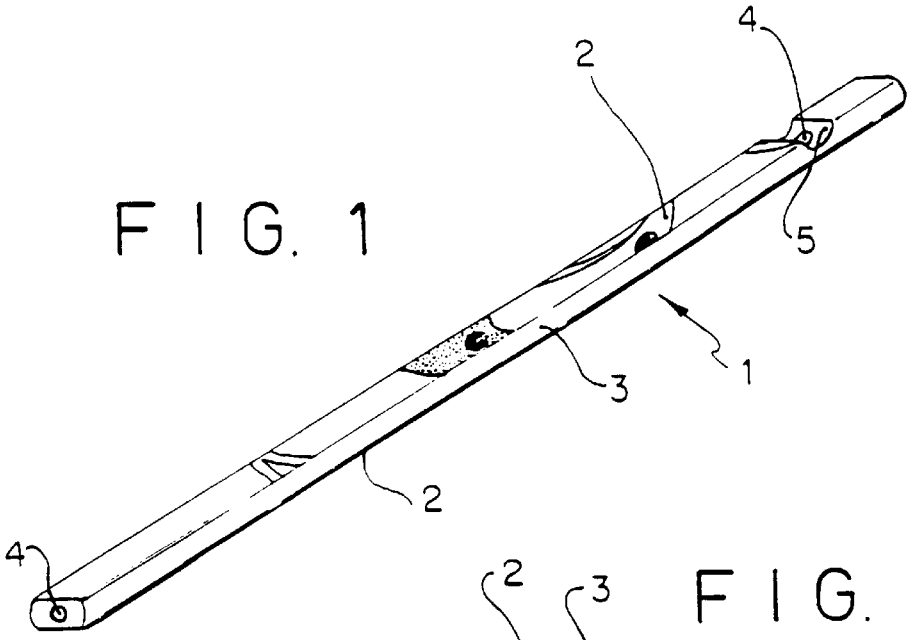

The invention refers to a pencil and more particularly to a colored pencil and to a set of pencils.

Pencils usually consist of an elongated body, normally of wood, inside which a black or colored lead is axially arranged along its whole length. They can have the most varied cross-section shapes, such as circular, square, rectangular, triangular, trapezoidal and others.

In known pencils, coats of paint are applied to the side surface, onto which other coats of paint or varnish can be applied to provide the finishing.

Sets of pencils that are packed and supplied in so-called pencil kits are also known. These contain several pencils, each having one lead of a given color or hue. They are also produced in the conventional way described above, and their side surfaces are painted the same color as the lead, so that the user can select, rapidly and unmistakably, the desired color for the work to be done.

Besides the above type, sets of colored pencils are also known with the side surfaces of all the pencils having a single color, the color identification of the lead of each pencil being made by means of the end of the pencil being painted a color corresponding to that of the lead.

The first object of the present invention is to provide a pencil that can be produced in a substantially cheaper manner than the conventional ones, without prejudice to its final ornamental finishing, and that permits immediate and unmistakable identification of the color of the lead, while not needing the known color identification means.

Another object is to mark a set of pencils configured in accordance with the invention, which, in addition to the obvious function of a pencil, provides a "puzzle" made therefrom, in order to stimulate creativity and intellectual development, especially of children.

The first object is attained, according to the invention, by means of a pencil, particularly a colored pencil, having at least one lateral cut-out along its length to expose a portion of the lead.

Preferably, the pencil has two substantially plane longitudinal faces opposed to each other, so that, when one is lying on a surface, the other will be facing upwardly so as to be seen. Longitudinal plane faces provide a better base for the pencil and allow it to be picked up more easily than in the conventional way.

In addition, the pencil of the invention can optionally include two curved longitudinal faces opposed to each other and contiguous to the respective longitudinal faces, the sum of the maximum longitudinal projections of each curve considering the cross-section of the pencil and the longitudinal faces in horizontal position—being much smaller than the dimension of the side face.

Since the cut-out is made to a depth reaching the lead, a portion of the latter remains visible, which allows the user to identify the color of the lead immediately, without the need for any indication by means of painting on the surface of the pencil. The cut-out is preferably concave.

The second object is achieved by means of a set of pencils comprising a plurality of pencils configured in accordance with the invention, the longitudinal plane faces of the pencils, when arranged in a determined ornamental sequence, forming an integral configurative pattern, each pencil preferably having a lead of a different color or hue and a respective cut-out exposing a portion of the corresponding lead.

The set of pencils formed with such pencils can be packed in a kit containing pencils, the range of colors or hues of the leads of which can be easily and rapidly identified.

In such an embodiment of a pencil and/or set of pencils, the paint that would be required for the coat of paint or varnish, that is to say, for the painting of the surfaces of the pencil, is used in a smaller amount for printing or forming a portion of a configurative pattern.

Less finishing material is required than if the pencil were manufactured in the conventional way, a subsequent finishing being not necessary, or a high quality finishing can be made with configurative patterns that are attractive for use or marketing.

The pencils can be taken out of the kit and thrown onto a surface in a disorderly manner, and one can set a goal for arranging them in a sequence in which they define or outline an integral configurative pattern, especially for the purpose of entertainment, as for instance a "puzzle" such as a figure, an advertisement mark, a landscape, etc.

Figure 2:
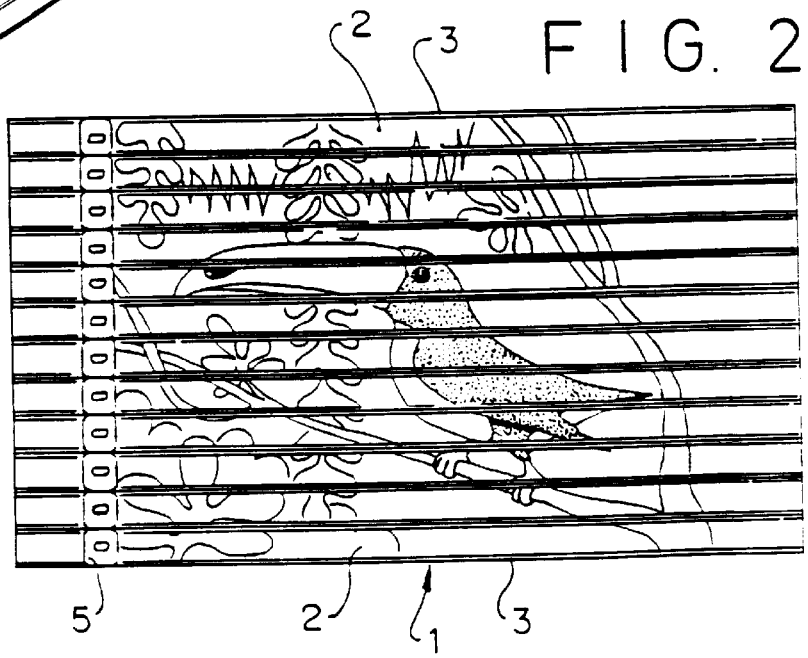
Figure 3:
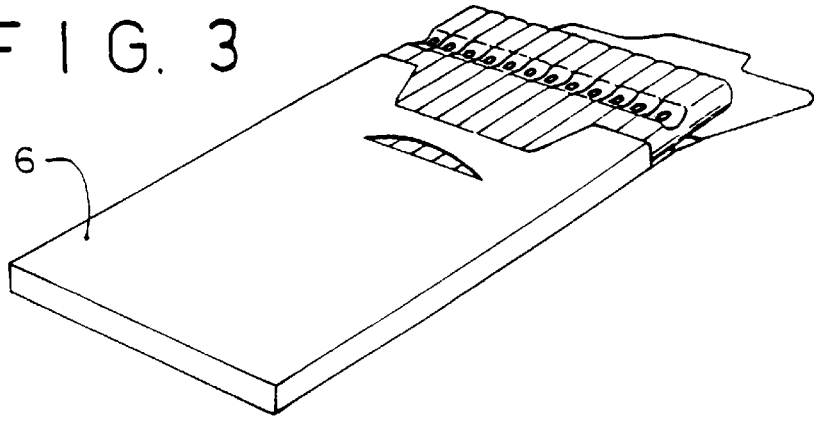

The invention will now be described in greater detail with reference to a preferred embodiment, represented in the drawings. The figures show:

FIG. 1: a perspective representation of a pencil in accordance with the invention;

FIG. 2: the presentation of a set of pencils in accordance with the invention, in which the pencils are arranged side by side; and FIG. 3: the representation of the set of pencils packed in a kit, the pencils being partly pulled out.

FIG. 1 shows the pencil of the invention consisting of an elongated body 1 having two elongated longitudinal plane faces 2—in the figure an upper one and a lower one opposed to each other, and two longitudinal faces 3 also opposed to each other and contiguous to faces 2, forming an approximately rectangular cross-section.

A lead 4, which can be of graphite or an equivalent colored material, is imbedded inside the body 1 and extends axially along its whole length.

The pencil is provided with a concave cut-out 5 at a certain distance from its upper end. The depth of the cut-out 5 extends only partially through the pencil, such that a portion of the lead remains visible, so that its color can be immediately identified.

Its upper longitudinal face 2 is provided with a partial configurative pattern that, considering only one pencil, is formed by lines and areas.

FIG. 2 shows a set made up of twelve colored pencils, which are arranged in an orderly manner, with their longitudinal plane faces 2 facing upwardly and disposed side by side. In this definite sequential position, the longitudinal faces 2 form or outline an integral pattern, such as a drawing. The cut-outs 5 allow one to see the color or hue of each lead of the respective pencil, so as to permit their immediate identification.

In order to permit a clear formation of the integral decorative pattern, the sum of the maximum horizontal projections of each arching of the arched longitudinal faces considering the cross-section of the pencil and the longitudinal faces 2 in the horizontal position—has to be much smaller than the dimension of the side face 2.

FIG. 3 shows the set of pencils of FIG. 2 packed in a kit 6, the pencils being represented partly pulled out, so as to permit identification of all the colors of the leads of the pencils contained in said kit 6.

The inventive assembly is especially suitable for use by children, since it can be used both as a writing and/or coloring tool and as a "puzzle"-type game, i.e., the pencils can be thrown or positioned at random on a surface, and the user must try putting them together in the determined sequence to form the illustration, drawing, mark, etc. The set of pencils can help the intellectual development and creativeness of children.

Although the invention has been described on the basis of a preferred embodiment, other embodiments obvious for a person skilled in the art are also to be included in the scope of the invention. For instance, one can imagine pencils with a square, hexagonal, rectangular and other cross-sections.

What is claimed is:

1. A colored pencil having an elongated wooden body and a lead provided within said elongated wooden body along its longitudinal axis, said lead extending along the full length of said elongated wooden body, wherein said elongated wooden body includes at least one concave lateral cut-out exposing a portion of said lead, said elongated body including at least two substantially plane longitudinal faces opposed to each other.

2. A pencil in accordance with claim 1, characterized in that said cut-out is made in at least one of said longitudinal faces.

3. A pencil in accordance with claim 1, whereby at least one of said substantially plane longitudinal faces is provided with a partial configurative pattern.

4. A set of pencils embracing a plurality of pencils in accordance with claim 3, wherein said substantially plane longitudinal faces of pencils arranged in a defined sequential orientation outline an integral configurative pattern, resulting from various of said partial configurative patterns.

5. A set of pencils in accordance with claim 4, wherein each of said pencils has a lead with a different color or hue and a respective of said cut-outs exposing a portion of said lead.

6. A set of pencils which includes a plurality of pencils according to claim 1 and which also is a puzzle type game, each of said pencils having markings on one of its substantially plane longitudinal faces, said markings on said pencils collectively forming an integral configurative pattern only when the pencils are positioned side by side in a determined sequence, said integral configurative pattern being formed of a plurality of pattern portions, each of said pencils including one of said pattern portions so that said set of pencils can be randomly arranged and a user can attempt to put them together in the determined sequence to form the integral configurative pattern.

7. A pencil according to claim 1 wherein the cutout has a depth which reaches the lead.

8. A pencil according to claim 7, wherein, said cut-outs being made in one of said substantially plane longitudinal faces.

9. A pencil according to claim 1, wherein said lateral cut-out extends only partially through the elongated wooden body to expose a portion of said lead so its color can be identified.

10. A colored pencil having an elongated wooden body and a lead provided within said elongated wooden body along its longitudinal axis, wherein said elongated wooden body includes at least one lateral cut-out, said lateral cut-out being concave and having a depth which extends only partially through the elongated wooden body to expose a portion of said lead so its color can be identified.

11. A pencil in accordance with claim 10, wherein said elongated wooden body includes at least two substantially plane longitudinal faces which are opposed to each other.

12. A pencil as in claim 11 wherein said elongated wooden body includes two arched longitudinal side faces which are opposed to each other and are contiguous to said substantially plane longitudinal faces, each of said longitudinal side faces having a width, said arched longitudinal side faces projecting horizontally from said substantially plane longitudinal faces when said substantially plane longitudinal faces are horizontal, said arched longitudinal side faces projecting horizontally from said substantially plane longitudinal faces by distances the sum of which is much smaller than the width of said substantially plane longitudinal side faces.

13. A pencil in accordance with claim 10, characterized in that said cut-out is made in at least one of said longitudinal faces.

14. A set of pencils embracing a plurality of pencils each of said pencils having an elongated wooden body with a longitudinal axis and a lead provided within said elongated wooden body along said longitudinal axis, wherein said elongated wooden body includes at least one lateral cut-out, said lateral cut-out having a depth which extends only partially through the elongated wooden body to expose a portion of said lead so its color can be identified, said pencils having faces provided with partial configurative patterns which collectively form an integral configurative pattern, said pencils being arranged in a sequence wherein said partial configurative patterns form said integral configurative pattern.

15. A set of pencils in accordance with claim 14, wherein each of said pencils has a lead with a different color or hue and a respective said cut-out exposes a portion of said lead.

16. A set of pencils which includes a plurality of pencils according to claim 1 and which also is a puzzle type game, each of said pencils having markings on one of its substantially plane longitudinal faces, said markings on said pencils collectively forming an integral configurative pattern only when the pencils are positioned side by side in a determined sequence, said integral configurative pattern being formed of a plurality of pattern portions, each of said pencils including one of said pattern portions so that said set of pencils can be randomly arranged and a user can attempt to put them together in the determined sequence to form the integral configurative pattern.

17. A pencil as in claim 1 wherein said elongated wooden body includes two arched longitudinal side faces which are opposed to each other and are contiguous to said substantially plane longitudinal faces, each of said longitudinal side faces having a width, said arched longitudinal side faces projecting horizontally from said substantially plane longitudinal faces when said substantially plane longitudinal faces are horizontal, sid arched longitudinal side faces projecting horizontally from said substantially plane longitudinal faces by distances the sum of which is much smaller than the width of said substantially plane longitudinal side faces.

* * * * *